US008849181B2

(12) United States Patent
Sugiyama

(10) Patent No.: US 8,849,181 B2
(45) Date of Patent: Sep. 30, 2014

(54) IMAGE FORMING APPARATUS INCLUDING CLIP UNIT, CLIP DEVICE, AND FINISHING APPARATUS

(75) Inventor: Hideaki Sugiyama, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 727 days.

(21) Appl. No.: 13/024,279

(22) Filed: Feb. 9, 2011

(65) Prior Publication Data

US 2011/0236103 A1 Sep. 29, 2011

Related U.S. Application Data

(60) Provisional application No. 61/317,206, filed on Mar. 24, 2010.

(51) Int. Cl.
*G03G 15/00* (2006.01)
*B42F 1/00* (2006.01)
*B42F 1/06* (2006.01)

(52) U.S. Cl.
CPC ..... *B42F 1/06* (2013.01); *G03G 2215/00869* (2013.01); *G03G 2215/0086* (2013.01); *B42F 1/003* (2013.01); *G03G 2215/00843* (2013.01); *G03G 15/6544* (2013.01)
USPC ..... 399/408; 399/407

(58) Field of Classification Search
CPC ..... B42F 1/003
USPC ..... 399/408
See application file for complete search history.

(56) References Cited

U.S. PATENT DOCUMENTS 6,547,230 B2 * 4/2003 Sato ..... 270/58.08
6,647,243 B2 * 11/2003 Sato et al. ..... 399/407
8,272,633 B2 * 9/2012 Yoshida et al. ..... 270/58.13
2009/0279718 A1 * 11/2009 Caploon ..... 381/124

FOREIGN PATENT DOCUMENTS

EP 865934 A1 * 9/1998

* cited by examiner

*Primary Examiner* — Anthony Nguyen
(74) *Attorney, Agent, or Firm* — Patterson & Sheridan LLP

(57) ABSTRACT

According to one embodiment, an image forming apparatus includes: an image forming unit configured to form an image to be printed on a sheet; an apparatus main body including the image forming unit therein; a recessed section provided on the outer side of the apparatus main body; and a clip unit configured to clip, when the sheet is inserted into the recessed section, an end of the sheet with a paper clip.

18 Claims, 19 Drawing Sheets

IMAGE FORMING APPARATUS INCLUDING CLIP UNIT, CLIP DEVICE, AND FINISHING APPARATUS

CROSS-REFERENCE TO RELATED APPLICATION

The present invention is based upon and claims the benefit of priority from the provisional application (61/317,206) filed on Mar. 24, 2010, the entire content of which is incorporated herein by reference.

FIELD

Embodiments described herein relate generally to an image forming apparatus including a clip unit, a clip device, and a finishing apparatus.

BACKGROUND

In the past, sheets printed by an image forming apparatus such as a multi function color copying apparatus (MFP) are usually stapled by a stapler, punched for binding, and bound and filed in a binder or the like.

However, when the sheets are punched in this way, it is difficult to reuse the sheets. Therefore, it is known that a clip is used to bind plural sheets without punching the sheets and, for example, left side surfaces of the sheets are fixed.

The present invention provides an image forming apparatus having a function of making it possible to clip sheets such that the sheets can be filed without being punched.

DETAILED DESCRIPTION

In general, according to one embodiment, an image forming apparatus includes: an image forming unit configured to form an image to be printed on a sheet; an apparatus main body including the image forming unit therein; a recessed section provided on the outer side of the apparatus main body; and a clip unit configured to clip, when the sheet is inserted into the recessed section, an end of the sheet with a paper clip.

Three embodiments of the present invention are explained below with reference to the accompanying drawings.

First Embodiment

Figure 1:
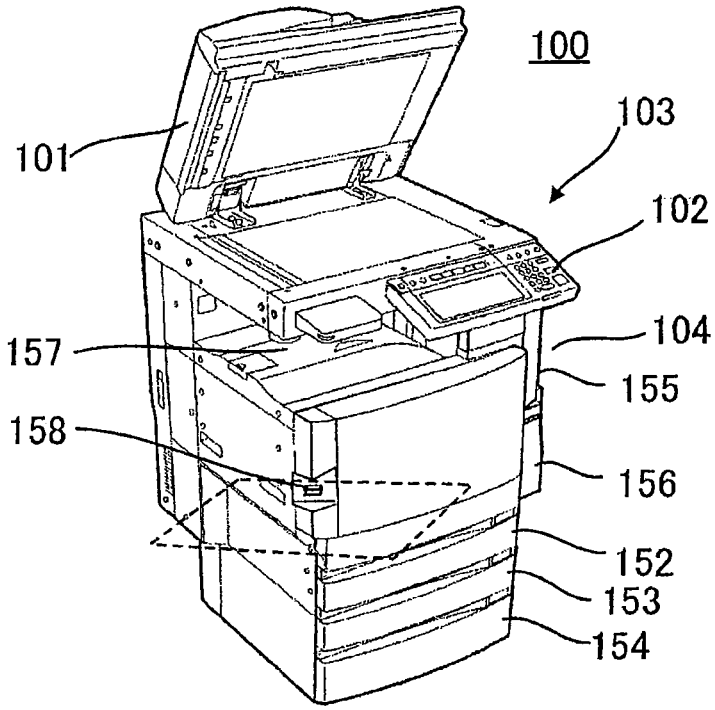
FIG. 1 is a perspective view of an external appearance of a multi function color copying apparatus according to a first embodiment of the present invention.

In the explanation of a first embodiment, it is assumed that the image forming apparatus is a multi function copying apparatus. FIG. 1 is a perspective view of an example of an external appearance of the multi function copying apparatus according to this embodiment.

An auto document feeder (ADF) 101 also functioning as a document cover and configured to automatically feed sheet-like documents one by one is openably and closably provided on an apparatus main body 103 of an image forming apparatus 100. An operation panel 102 including various operation keys and various display devices for instructing copy condition and copy start is provided in a front part of an upper surface of the apparatus main body 103 of the image forming apparatus 100.

A handle 104 is provided below the operation panel 102 on a front surface of the apparatus main body 103 to make it easy to open the inside of the main body when a paper jam or the like occurs.

Paper feeding cassettes 152, 153, and 154 are attachably and detachably provided in a lower part of the image forming apparatus 100. Sheets of the same size are stored in a lateral direction or a longitudinal direction in each of the paper feeding cassettes 152, 153, and 154. In printing, a paper feeding cassette is selected and sheets are fed from the selected paper feeding cassette.

Terminals such as parallel ports, serial ports, and an SCSI not shown in the figure are provided on a rear surface of the image forming apparatus 100. The parallel ports connect the apparatus and external apparatuses such as a personal computer (PC) when the apparatus is caused to operate as a printer.

The serial ports connect the apparatus and external apparatuses such as a PC to read out internal management information of the apparatus during maintenance of the apparatus and set functions of the apparatus.

The SCSI performs communication of commands and data between the apparatus and an external controller that operates as a master.

On a right side section of the apparatus main body 103, an automatic duplex unit 155 for performing duplex copying and a manual feed tray 156, which can be folded when not in use, for manually feeding a sheet are attachably and detachably provided. A paper discharge tray 157 for receiving a printed sheet is provided in the apparatus main body 103.

The operation panel 102 is provided on a front surface of the image forming apparatus 100. A clip unit 145 explained in detail later is provided in a recessed section 158 at a corner in the center of a body of the image forming apparatus 100. Therefore, it is easy to bind printed sheets (indicated by a dotted line) discharged to the paper discharge tray 157 and clip the sheets with a clip processing unit 149.

Figure 2:
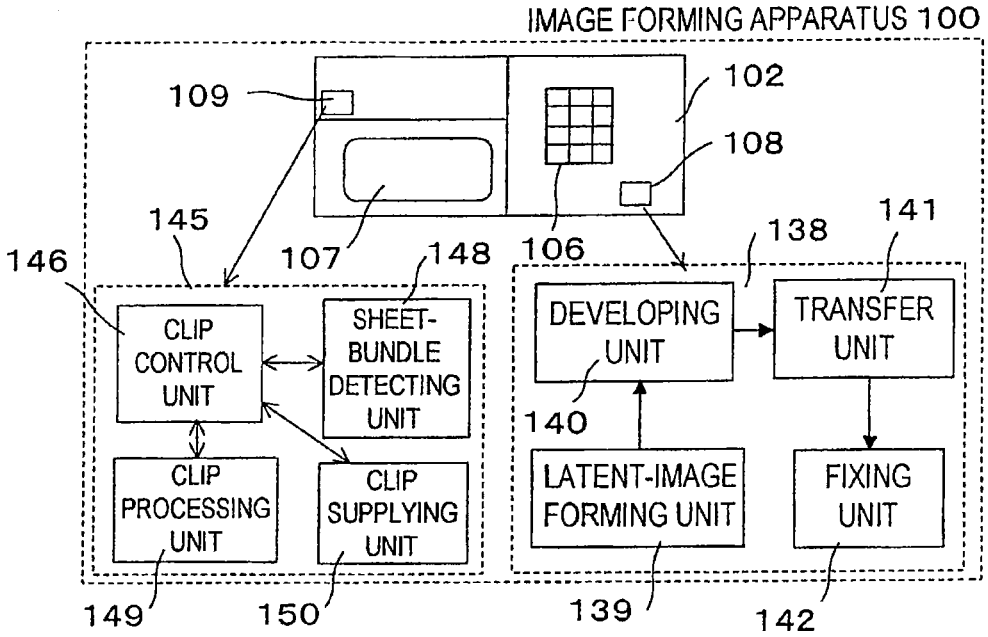
FIG. 2 is a diagram of an electric configuration of the copying apparatus according to the embodiment.

An electric configuration of the image forming apparatus 100 and a relation between the electric configuration and the operation panel 102 are shown in FIG. 2. On the operation panel 102 of the image forming apparatus 100, besides number keys 106 and a touch panel display 107, a print key 108 for forming an image and instructing print processing and a clip key 109 for instructing clip processing for clipping plural sheets, i.e., a bundle of sheets are provided.

When the print key 108 is pressed, an image forming unit 138 operates. The image forming unit 138 includes a latent-image forming unit 139 configured to scan, for example, an image to be copied and generate an optical latent image, a developing unit 140 configured to develop, with a toner or the like, the latent image generated by the latent-image forming unit 139, a transfer unit 141 configured to transfer a visible image developed by the developing unit 140 onto a sheet, and a fixing unit 142 configured to fix the transferred image. The sheet having the image fixed thereon is discharged to the paper discharge tray 157.

On the other hand, when the clip key 109 is pressed, the clip unit 145 operates. The clip unit 145 includes a clip control unit 146 configured to control the entire clip processing, a sheet-bundle detecting unit 148 configured to detect that sheets discharged to the paper discharge tray 157 are inserted into the recessed section 158 as a bundle, the clip processing unit 149 configured to place a paper clip 201 on an end of the sheet bundle and clip the sheet bundle, and a clip supplying unit 150 configured to supply the paper clip 201 to be used next.

Figure 3:
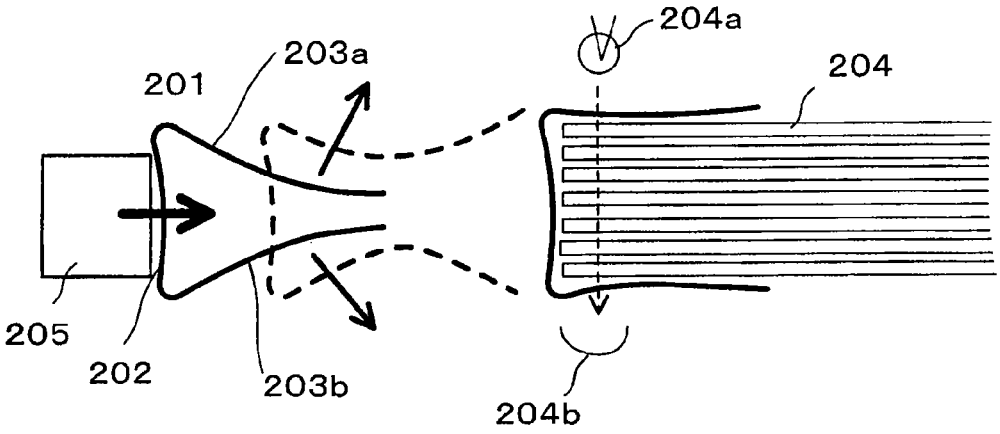
FIG. 3 is a sectional view for explaining an operation of clip processing in a clip unit according to the embodiment.
Figure 4:
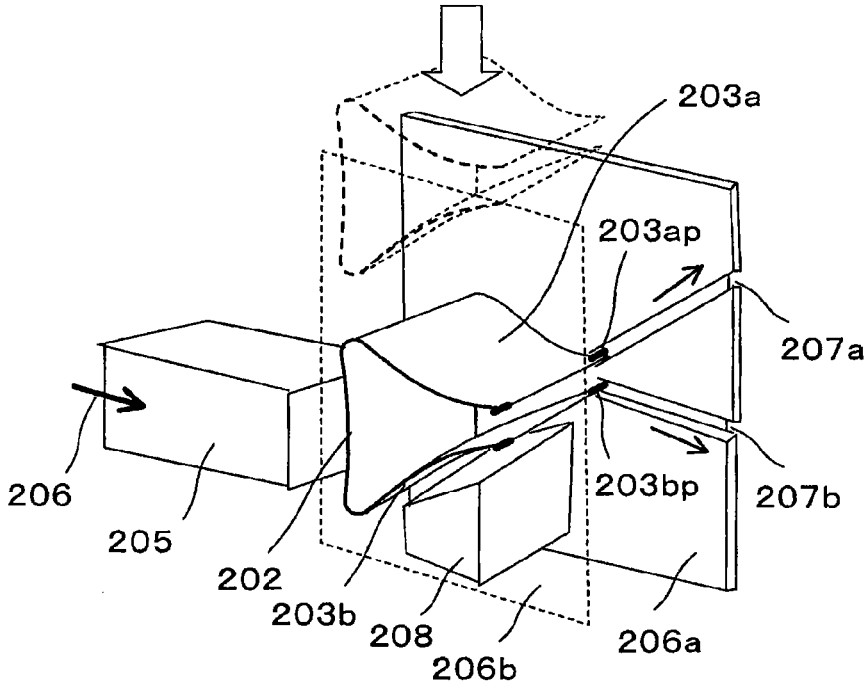
FIG. 4 is a perspective view for explaining a mechanism and an operation in the clip unit according to the embodiment.

A sectional view and a perspective view for explaining an operation of the clip unit 145 are respectively shown in FIGS. 3 and 4. A plurality of the paper clips 201 are stored in a longitudinal direction in the clip supplying unit 150 of the clip unit 145. The paper clip 201 is a member having a C shape in section and predetermined width. The paper clip 201 includes a rear surface section 202 and a pair of side surface sections 203*a* and 203*b*. At least the side surface sections 203*a* and 203*b* of the paper clip 201 have resilience and have a function of closing in a direction in which the side surface sections 203*a* and 203*b* approach each other. The side surface sections 203*a* and 203*b* have projections 203*ap* and 203*bp* on both sides at distal ends thereof. A side plate 206*a* is explained below. However, the same applies to a side plate 206*b*.

When the clip unit 145 is used, an operator inserts a position desired to be clipped of a bundle of sheets 204 desired to be clipped into the recessed section 158 shown in FIG. 1 and holds the bundle of the sheets 204.

A light source 204*a* and a photodetector 204*b* are provided above and below the recessed section 158 to make it possible to detect the bundle of the sheets 204. The light source 204*a* and the photodetector 204*b* are included in the sheet-bundle detecting unit 148.

The paper clip 201 is held between the side plates 206*a* and 206*b* on both side surfaces of the paper clip 201. Oblique grooves 207*a* and 207*b* are provided on the inner sides of the side plates 206*a* and 206*b*. The projections 203*ap* and 203*bp* of the side surface sections 203*a* and 203*b* of the paper clip 201 fit in these grooves.

When the operator presses the clip key 109 of the operation panel 102 in this state, the paper clip 201 placed on a clip table 208 is pressed from the rear surface of the paper clip 201 by a pressing bar 205 in a lateral direction indicated by an arrow 206.

Then, the projections 203*ap* and 203*bp* of the side surface sections 203*a* and 203*b* of the paper clip 201 are guided by the oblique grooves 207*a* and 207*b*. The side surface sections 203*a* and 203*b* of the paper clip 201 open to the outer sides as indicated by a dotted line in FIG. 3. The paper clip 201 nips and clips the bundle of the sheets 204. When the pressing bar 205 is returned in a direction opposite to the arrow 206, the paper clip 201 clips a predetermined position of an end face of the bundle of the sheets 204.

A configuration example of a control system of the entire multi function copying apparatus according to this embodiment is explained with reference to FIG. 5. The image forming apparatus 100 includes the clip unit 145 configured to perform the clip processing explained above, a system CPU 500, a flash ROM 501 for storing computer programs and fixed data, a font ROM 502 for converting text data into font data, and a nonvolatile RAM (NVRAM) 503 and a DRAM 504 for work and for data storage.

The system CPU 500 performs control of the entire apparatus. In the following explanation, the system CPU 500 performs control of functions according to an instruction signal from the operation panel 102 by the operator, a signal input from a communication line, and input signals from various external interfaces.

A scanner interface (SIF) 505 receives image data from a scanner unit 505S. An image processing circuit 506 performs image editing processing according to printing media such as image quality improvement processing, expansion and reduction processing, pixel thinning-out processing, and white void processing for a designated area by marker detection.

A printer interface (PIF) 507 gives image data to a printer unit 507P. A page memory 508 stores, in page unit, image data subjected to image processing by the image processing circuit 506 and waiting to be output. The page memory 508 has a function of a page buffer for temporarily storing the image data and incorporates a codec configured to perform compression and expansion.

Control signals are exchanged between the system CPU 500 and the devices by a system bus 511 at high speed.

Concerning the operation of the clip unit 145, when the clip key 109 on the operation panel 102 is pressed, a control signal is sent from the operation panel 102 to the clip unit 145 via the system bus 511. The clip processing is performed in the clip unit 145.

On the other hand, the devices related to processing of an image signal are connected via an image bus 512. The image bus 512 is provided for the apparatus to operate as a copying machine. In order to guarantee a real-time operation of the copying machine, the scanner interface (SIF) 505 receives image data input from the scanner unit 505S. The image processing circuit 506 performs the various kinds of editing processing such as the image quality improvement processing and the expansion and reduction processing. The printer interface 507 outputs the image data to the printer unit 507P. These operations are performed in parallel. This processing is referred to as basic copying.

Among boards connected to the image bus 512, the image data is not processed in processing boards unnecessary for the current operation. A large-capacity storage device, for example, a hard disk driving circuit (HDD) 509 stores, for example, image data given from an external apparatus and image data related to printing of plural copies obtained in the scanner unit 505S.

A printer network controller (PRNC) 510 includes an interface with the printer unit 507P side configured to control an image forming function during a copying operation and a printer operation. At the same time, the printer network controller (PRNC) 510 is connected to a LAN via an incorporated device such as a network interface card. The printer network controller (PRNC) 510 performs protocol control and data transfer, compression, and expansion control for receiving print data from a device such as a personal computer on the outside via the LAN, buffering the data, and transferring the data to the printer unit 507P side.

As shown in FIG. 2, on the operation panel 102, the touch panel display 107 is provided on the front side on the left, the clip key 109 is provided above the touch panel display 107, and the print key 108 is provided on the front side on the right. Besides, a start key, a stop key, a reset key, a ten key for setting numbers, a function mode selection key for enabling selection of function modes such as copying and facsimile, and the like are provided on the operation panel 102. Print is a mode used when a personal computer or the like is connected to the outside to perform printing. The operator can input an instruction by touching the touch panel display 107 with a finger or the like. The touch panel display 107 can display states of the units of the image forming apparatus 100.

The number keys 106 are arranged in the same manner as a ten key array of a push-button telephone such that the number keys 106 can be commonly used in copying, facsimile, and print.

For example, a touch panel guidance screen is displayed on the touch panel display 107. As modes, there are five modes of basic, image adjustment, application, storage, and confirmation. The operator can select one of the modes by touching a relevant tab displayed on the touch panel display 107.

Figure 5:
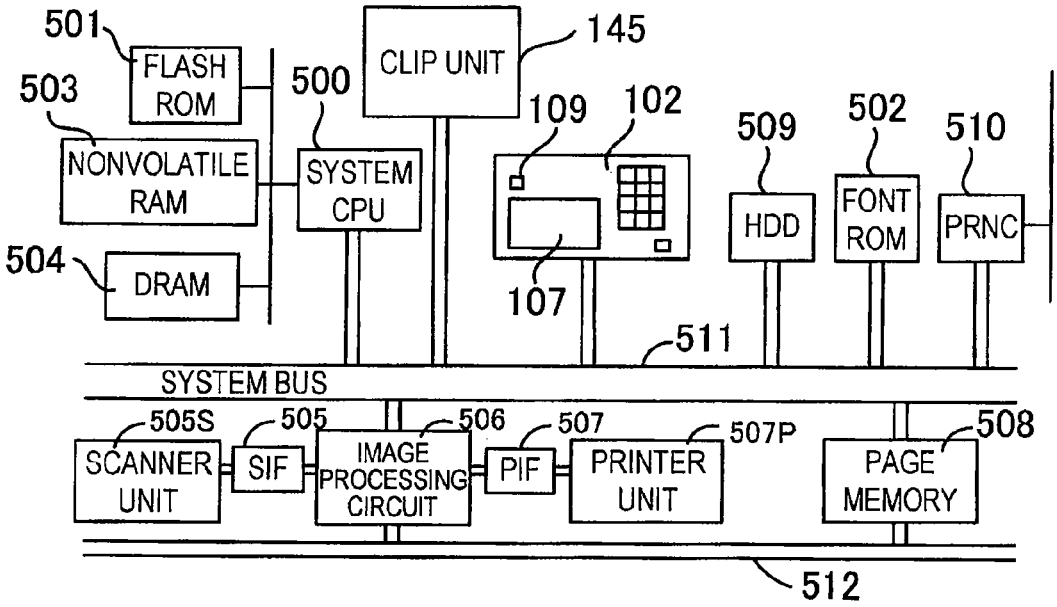
FIG. 5 is a diagram of an overall configuration example of a control system of the entire copying apparatus according to the embodiment.

Control of the entire image forming apparatus 100 is performed via the system CPU 500 shown in FIG. 5 according to information designated on the operation panel 102 including the touch panel display (TPD) 107. For example, when copying is performed, as shown in FIG. 1, a document or the like desired to be copied is placed on a glass surface of the upper surface of the apparatus, the ADF 101 is closed, light from a light source is projected from a lower surface, and a latent image is formed on a not-shown photoconductive drum included in the latent-image forming unit 139 using reflected light. The latent image is developed with a toner or the like and visualized in the developing unit 140. The visualized image is transferred onto a sheet in the transfer unit 141. A toner image on the recording sheet onto which the image is transferred is, for example, heated and subjected to fixing processing in the fixing unit 142.

Figure 6:
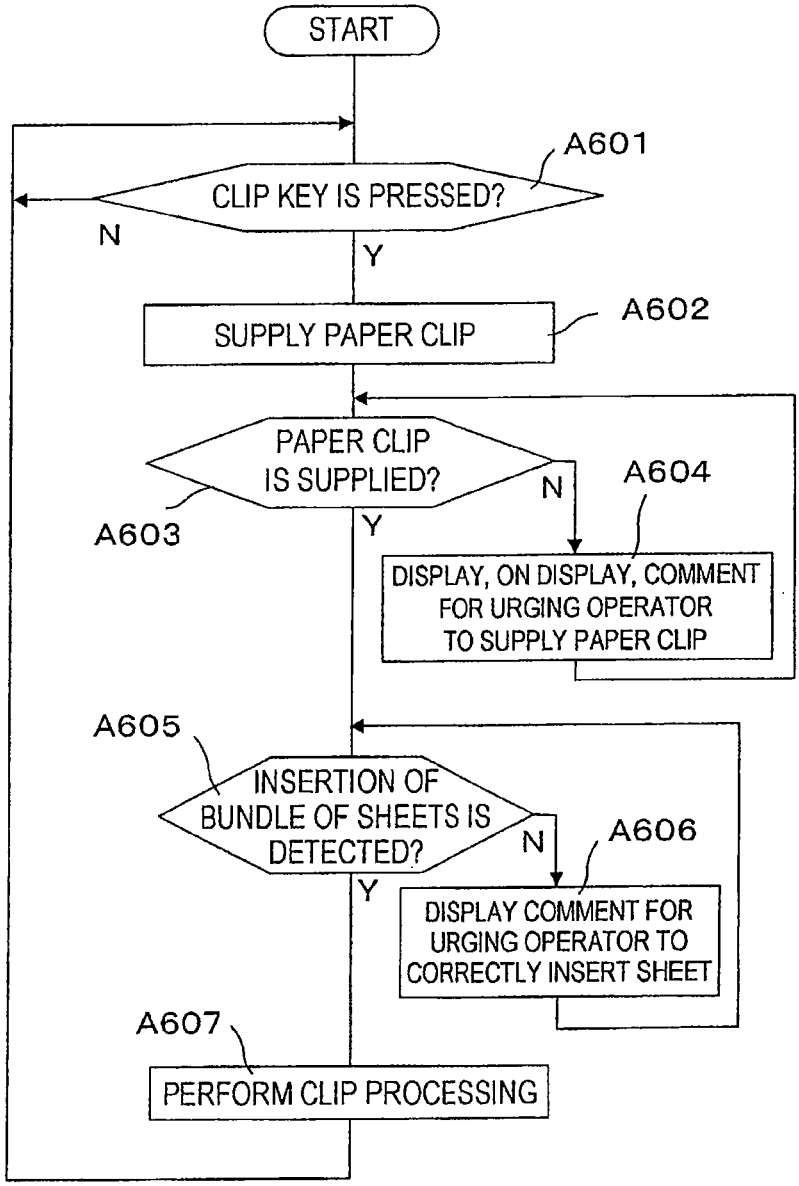
FIG. 6 is a flowchart for explaining the operation in the clip unit according to the embodiment.

An operation of the clip processing in the clip unit 145 is explained with reference to a flowchart of FIG. 6.

When the clip processing is started, first, in Act A601, the clip unit 145 detects whether the clip key 109 on the operation panel 102 is pressed. If the pressing of the clip key 109 is detected, in Act 602, the paper clip 201 is supplied from the clip supplying unit 150 (from above in FIG. 4) and placed on the clip table 208 (A602).

In the next Act A603, the clip unit 145 detects whether the paper clip 201 is supplied. If the paper clip 201 is not supplied, since the paper clip 201 is absent, in Act A604, the clip unit 145 displays, on a display surface of the touch panel display 107, a comment for urging the operator to supply the paper clip 201 and returns to Act A603.

If the paper clip 201 is present, in the next Act A605, the clip unit 145 detects, in the sheet-bundle detecting unit 148 shown in FIG. 2, whether a bundle of sheets is detected in the recessed section 158. If light emitted from the light source 204*a* reaches the photodetector 204*b*, sheets are not inserted or, even if sheets are inserted, the insertion is shallow.

If sheets are not detected (N in Act A605), in Act A606, the clip unit 145 displays, on a screen of the touch panel display 107, indication that sheets are not detected and a comment for urging the operator to correctly insert sheets in the recessed section 158 and returns to Act A605.

If a bundle of sheets is correctly detected (Y in Act A605), the clip unit 145 shifts to Act A607, performs the clip processing with the clip processing unit 149, and returns to Act A601.

Figure 7:
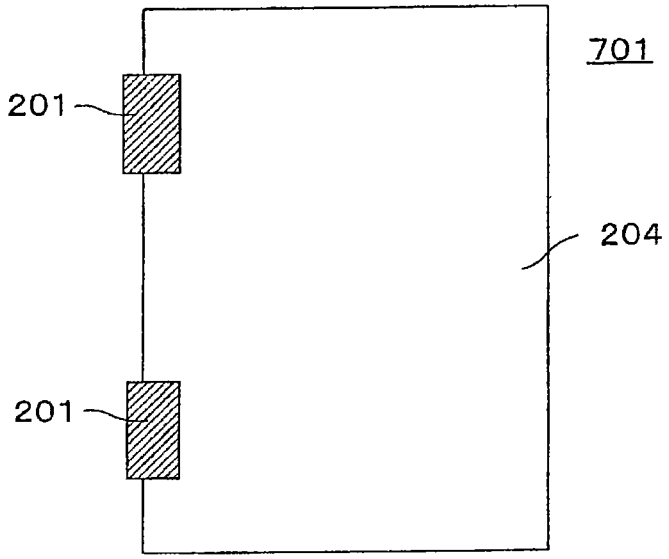
FIG. 7 is a front view of a booklet subjected to the clip processing according to the embodiment.

A front view of a bundle of sheets clipped with the paper clips 201 in two places at the left end by the clip unit 145 of the image forming apparatus 100 is shown in FIG. 7. The bundle of sheets created in this way can be regarded as a booklet 701.

However, a bundle of sheets having necessary unity is often too thick to be clipped by the one paper clip 201. Moreover, a thickness of the paper clip can not be increased so much. Therefore, a file that can collectively file booklets clipped by the paper clips 201 is explained below. The paper clips 201 used in the file are made of a magnetic material having elasticity.

Figure 8:
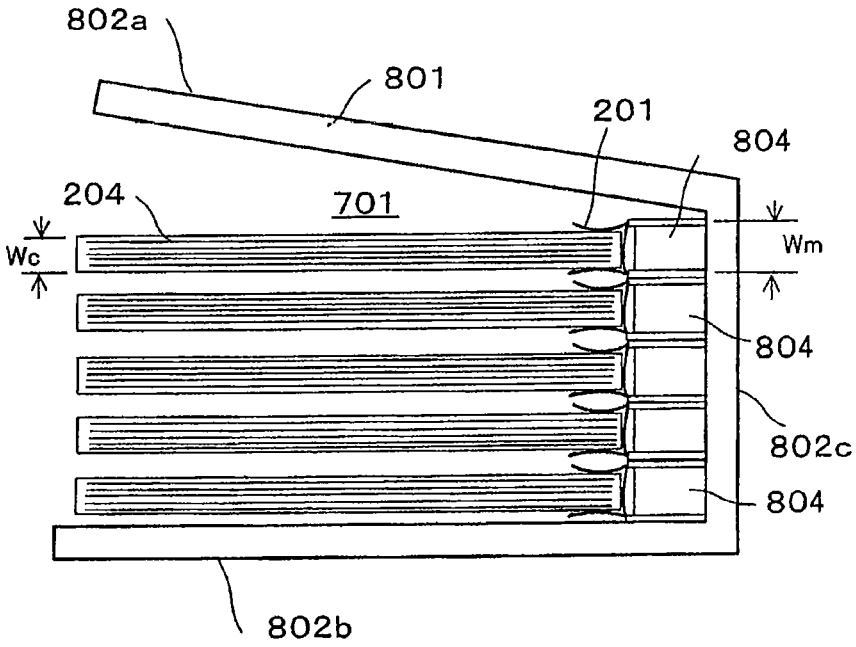
FIG. 8 is a diagram of a structure of a file for filing a plurality of the booklets subjected to the clip processing shown in FIG. 7.

A structure of the file that can be used in such a case is shown in FIG. 8. A file cover 801 of the file includes a cover 802 including a front cover 802*a*, a back cover 802*b*, and a spine 802*c* and bar-like plural permanent magnets 804 rectangular in section fixed in parallel on the inner side of the spine 802*c*.

The booklet 701 including the sheets 204 and the paper clips 201 shown in FIG. 7 is fixed to the permanent magnets 804 of the file cover 801 by magnetic force as a unit booklet. In other words, the booklet 701 is fixed to the permanent magnets 804 in the file cover 801 by the magnetic force through the paper clips 201.

It is desirable to set a thickness We of the paper clip 201 to be the same or smaller than a thickness Wm of the permanent magnet 804. If such a relation of the thicknesses is set, since it is possible to fix unit booklets to correspond to the permanent magnets 804, it is possible to create a file that can be easily attached and detached.

In the embodiment explained above, an example in which the recessed section for the clip unit is provided at the corner in the center in the front on the left side of the apparatus main body of the copying apparatus is explained. However, the position of the recessed section is not limited to this position. The recessed section may be provided anywhere on the outside of the apparatus main body.

In the embodiment, an example in which the insertion of sheets into the recessed section is detected according to block of light by the light source and the photodetector is explained. However, the present invention is not limited to such optical detection. A bundle of sheets can also be detected by a mechanical device such as a switch.

In the embodiment, the image forming apparatus in which the clip unit operates when the operator presses the clip key on the operation panel after the insertion of a bundle of sheets is detected is explained. However, it is also possible to cause the clip unit to automatically operate when a bundle of sheets is inserted into the recessed section. In the embodiment, the recessed section provided on the outside of the image forming apparatus is not covered at all. However, usually, the recessed section may be covered with a cover. The cover may be removable or may be openably and closably attached to the apparatus main body by hinges or the like. When the cover is provided in this way, it is possible to cause the sheet-bundle detecting unit to start operation when the cover is opened.

In the embodiment, the apparatus in which the touch panel display is provided on the upper surface of the apparatus main body is explained. However, in the present invention, rather than the touch panel display; a display in which information is displayed on a screen only has to be provided. The display is not always necessary.

In the embodiment, the clip unit is applied to the multi function copying apparatus. However, in the present invention, the clip unit can be provided in another image forming apparatus such as a normal copying machine, a printer, or a facsimile apparatus that includes an image forming unit configured to generate an image to be printed on a sheet and designates a paper type to be printed.

Second Embodiment

Figure 9:
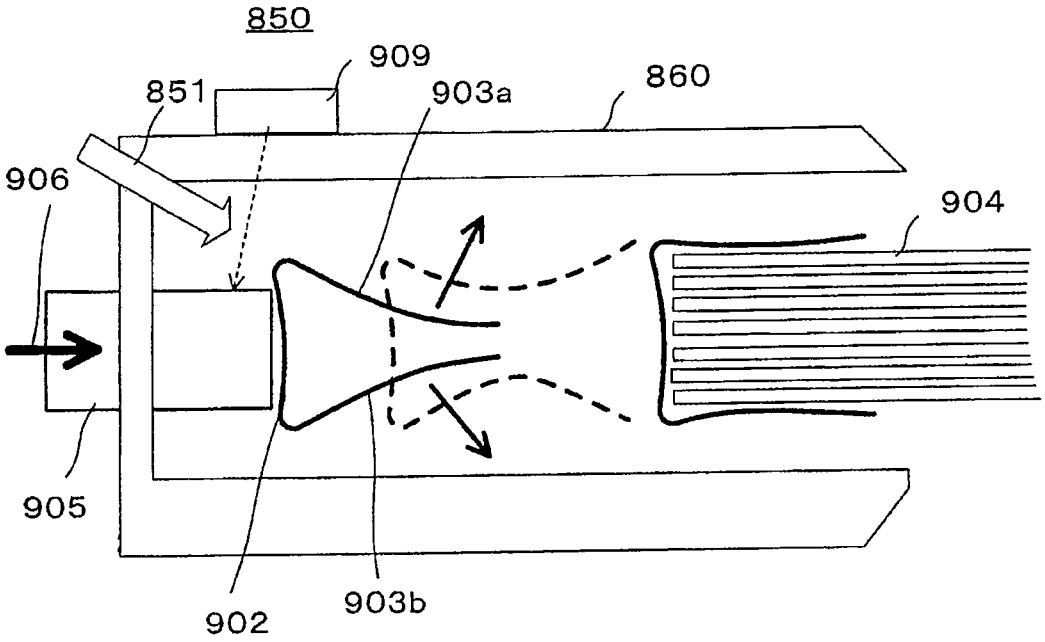
FIG. 9 is a diagram of a structure according to a second embodiment.
Figure 10:
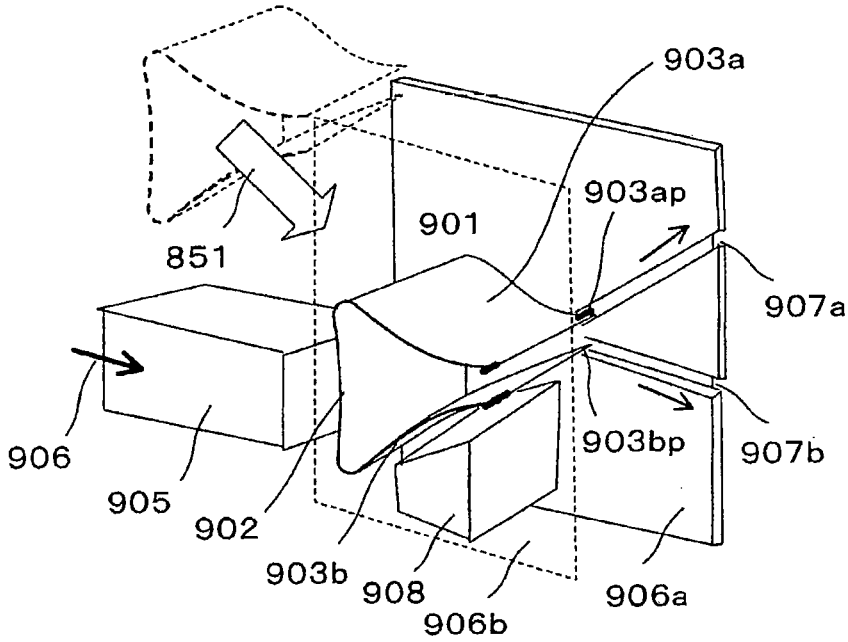
FIG. 10 is a diagram for explaining an operation according to the second embodiment.

The structure of a second embodiment of the present invention is shown in FIG. 9. In the second embodiment, the clip unit is provided as a single clip device. The booklet 701 shown in FIG. 7 can also be created by the clip device.

A paper clip 901 is supplied to a clip device 850 in an obliquely above direction indicated by an arrow 851. The paper clip 901 is a member having a C shape in section and predetermined width. The paper clip 901 includes a rear surface section 901 and a pair of side surface sections 903*a* and 903*b*. At least the side surface sections 903*a* and 903*b* of the paper clip 901 have resilience and have a function of closing in a direction in which the side surface sections 903*a* and 903*b* approach each other. The side surface sections 903*a* and 903*b* have projections 903*ap* and 903*bp* on both sides at distal ends thereof. A side plate 906*a* is explained below. However, the same applies to a side plate 906*b*.

The paper clip 901 is held between the side plates 906*a* and 906*b* on both side surfaces. Oblique grooves 907*a* and 907*b* are provided on the inner sides of the side plates 906*a* and 906*b*. The projections 903*ap* and 903*bp* of the side surface sections 903*a* and 903*b* of the paper clip 901 fit in the grooves 907*a* and 907*b*.

When an operator presses a clip key 909 provided in a main body 860 of the clip device 850 in this state, the paper clip 901 placed on a clip table 908 is pressed from the rear surface of the paper clip 901 by a pressing bar 905 in a lateral direction indicated by an arrow 906.

Then, the projections 903*ap* and 903*bp* of the side surface sections 903*a* and 903*b* of the paper clip 901 are guided by the oblique grooves 907*a* and 907*b*. The side surface sections 903*a* and 903*b* of the paper clip 901 open to the outer sides as indicated by a dotted line in FIG. 9. The paper clip 901 nips and clips a bundle of sheets 904. When the clip key 909 is pressed again, the pressing bar 905 is returned in a direction opposite to the arrow 906 and the paper clip 901 clips a predetermined position of an end face of the bundle of the sheets 904.

Third Embodiment

In a third embodiment, the clip unit is incorporated in a finishing apparatus of an image forming apparatus.

Figure 11:
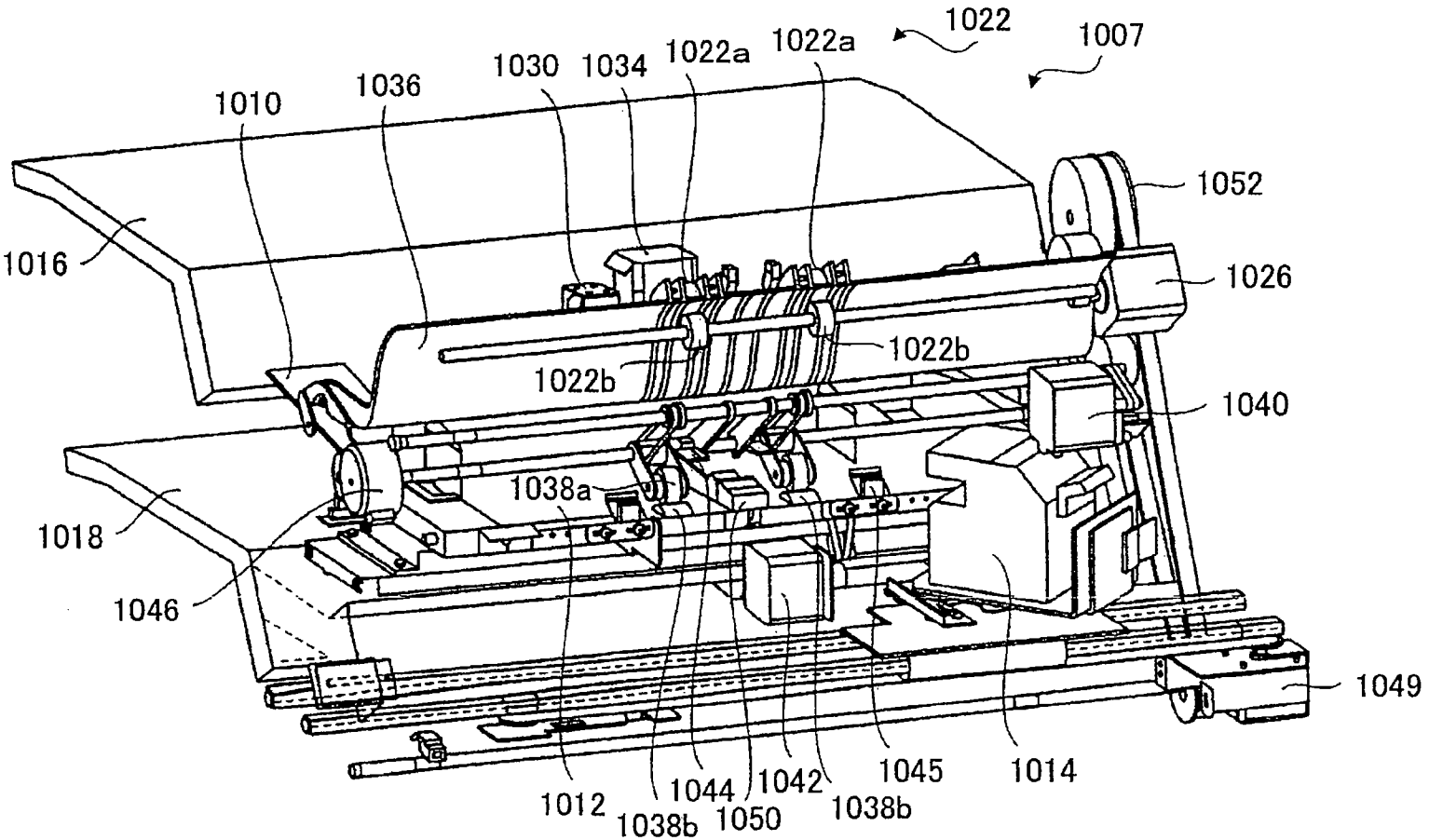
FIG. 11 is a diagram of a main part of a finishing apparatus according to a third embodiment.
Figure 12:
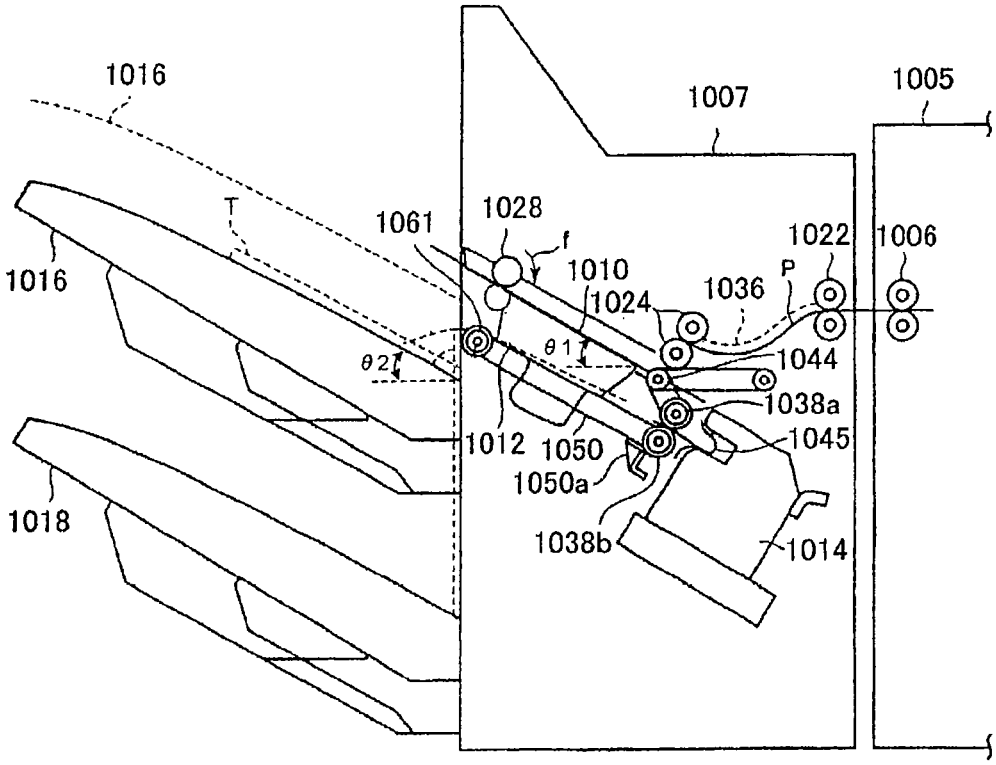
FIG. 12 is a schematic diagram of a configuration of the finishing apparatus according to the third embodiment.

FIG. 11 is a perspective view of a main part of a finishing apparatus 1007 in which the clip unit according to this embodiment is incorporated. FIG. 12 is a schematic diagram of a configuration of the finishing apparatus 1007 arranged adjacent to an image forming apparatus 1005 such as a copying machine.

The finishing apparatus 1007 basically includes a waiting tray 1010, a processing tray 1012, a clip unit 1014, a first paper discharge tray 1016, and a second paper discharge tray 1018. The clip unit 1014 is a unit to receive supply of a paper clip and perform clip processing.

The waiting tray 1010 includes a pair of sheet supporting surfaces that can open and close to the left and right. When the pair of sheet supporting surfaces are opened, a stacked group of sheets drop from the waiting tray 1010 onto the processing tray 1012.

As shown in FIG. 12, a sheet P having an image formed thereon by the image forming apparatus 1005 such as a copying machine and discharged from a pair of paper discharge rollers 1006 is received by a pair of inlet rollers 1022, supplied to a pair of paper feeding rollers 1024, and sent from the paper feeding rollers 1024 to the waiting tray 1010.

The inlet rollers 1022 are driven by an inlet roller motor 1026. A paper guide 1036 configured to lead the sheet P to the paper feeding rollers 1024 is provided between the inlet rollers 1022 and the waiting tray 1010. The inlet rollers 1022 include an upper inlet roller 1022*a* and a lower inlet roller 1022*b*. The paper feeding rollers 1024 include an upper paper feeding roller and a lower paper feeding roller.

The processing tray 1012 on which the sheet P dropped from the waiting tray 1010 is stacked is arranged below the waiting tray 1010. The processing tray 1012 aligns and supports the sheet P stacked while the sheet P is subjected to the clip processing by the clip unit 1014, which is a processing mechanism configured to perform finishing.

The clip unit 1014 receives a control signal from a control unit (not shown) disposed in the finishing apparatus 1007. The clip unit 1014 is positioned by a clip-unit driving unit 1085 and the clip processing is controlled.

Information concerning a sheet to be subjected to image formation is sent from the image forming apparatus 1005 to the control unit of the finishing apparatus 1007. First, the clip unit 1014 changes a position thereof from a home position to be parallel to a front end of the sheet P (a leading end in a sheet conveying direction) and moves to near the center of a sheet width dimension. Subsequently, the clip unit 1014 moves in an outward direction of a sheet width in parallel to the front end of the sheet P by a predetermined distance from near the center of the sheet width. This is for the purpose of reducing a processing time by moving the clip unit 1014 in parallel. Therefore, the predetermined distance is suitably set to, for example, ¼ to ⅓ of the width dimension of the sheets P.

The clip unit 1014 moved from near the center of the sheet width to a predetermined position rotates at an angle smaller than 45 degrees, for example, 30 degrees in the predetermined position and further moves in the outward direction of the sheet width. After moving forward by a moving distance corresponding to the sheet width, the clip unit 1014 performs the clip processing in a desired position B or C. Therefore, even if a sheet size is different, the clip processing is performed at the same angle.

The desired position is, for example, a position set by an operator on an operation unit disposed in the image forming apparatus 1005. If the operator does not set a designated position, appropriate position information for each sheet size prepared in advance may be set as the desired position.

Figure 15:
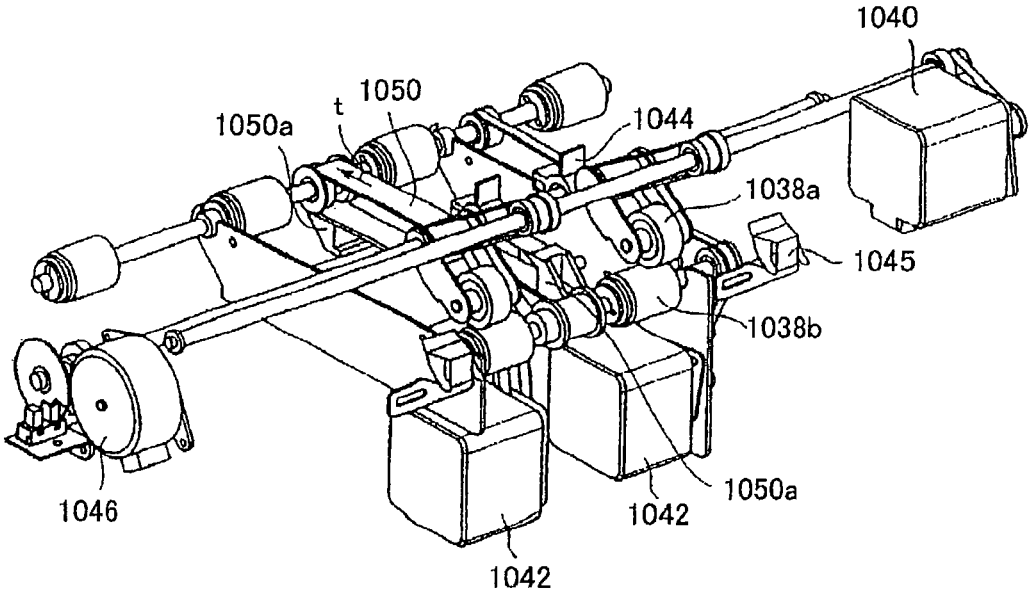
FIG. 15 is a perspective view of longitudinal alignment rollers according to the embodiment.

The processing tray 1012 includes a pair of upper longitudinal alignment roller 1038*a* and lower longitudinal alignment roller 1038*b* shown in FIG. 15 configured to align, in a longitudinal direction as the conveying direction, a plurality of the sheets P dropped from the waiting tray 1010. The upper and lower longitudinal alignment rollers 1038*a* and 1038*b* also function as bundle conveying rollers configured to hold a sheet bundle after the end of the clip processing and extract the sheet bundle from the clip unit 1014. The upper longitudinal alignment roller 1038*a* is driven by a longitudinal alignment upper roller motor 1040. The lower longitudinal alignment roller 1038*b* is driven by a longitudinal alignment lower roller motor 1042.

Figure 14:
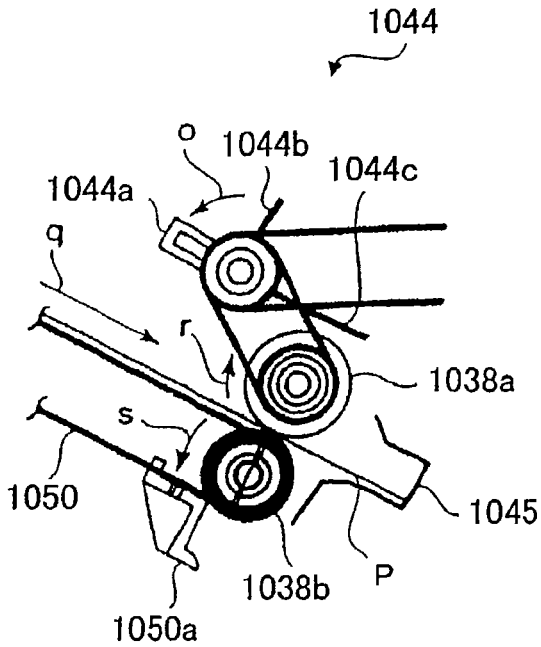
FIG. 14 is a schematic front view of a paddle according to the embodiment.

A paddle 1044 rotatable to align, in the longitudinal direction, the top sheet P placed on the processing tray 1012 is arranged in a position where a trailing end of the sheet P drops when the sheet P is dropped to the processing tray 1012. The paddle 1044 includes, as shown in FIG. 14, a receiving section 1044*a* for the sheet P dropped onto the processing tray 1012, a tapping section 1044*b* for tapping down the sheet P onto the processing tray 1012, and a feeding section 1044*c* for aligning the sheet P on the processing tray 1012. The paddle 1044 is driven by a paddle motor 1046. The paddle 1044 is made of a rubber material and has elasticity.

A stopper 1045 with which the trailing end of the sheet P is brought into contact to regulate a trailing end position is provided at an end on the clip unit 1014 side of the processing tray 1012. A conveyor belt 1050 configured to convey the sheet bundle subjected to the clip processing and extracted from the clip unit 1014 by the upper and lower longitudinal alignment rollers 1038*a* and 1038*b* to the first paper discharge tray 1016 or the second paper discharge tray 1018 is provided substantially in the center of the processing tray 1012. A feeding pawl 1050*a* configured to hook the trailing end of the sheet bundle is provided in the conveyor belt 1050.

As shown in FIG. 12, the sheet supporting surfaces of the waiting tray 1010 open and the sheet P can be dropped onto the processing tray 1012. On the other hand, the sheet P can be conveyed in the direction of the first paper discharge tray 1016 or the second paper discharge tray 1018. The conveyance of the sheet P in the direction of the paper discharge tray 1016 or 1018 is performed by bringing a waiting tray roller 1028, which performs alignment of the sheet P, into contact with the sheet P on the waiting tray 1010. The waiting tray roller 1028 is controlled to move up and down by a waiting tray roller driving source 1030.

The waiting tray 1010 is arranged at a tilt angle θ1 in order to support the sheet P in a state in which the leading end of the sheet P is higher than the trailing end of the sheet P. The first paper discharge tray 1016 or the second paper discharge tray 1018 is lifted and lowered by a paper-discharge-tray driving unit 1052 and selected. When the sheet P is stacked, the first paper discharge tray 1016 or the second paper discharge tray 1018 is lifted or lowered to a height substantially the same as the height of the waiting tray 1010 or the processing tray 1012 to realize improvement of alignment of the discharged sheet P. The first paper discharge tray 1016 or the second paper discharge tray 1018 is arranged at a tilt angle θ2 in order to support the sheet P in a state in which the leading end of the sheet P is higher than the trailing end of the sheet P.

Figure 16:
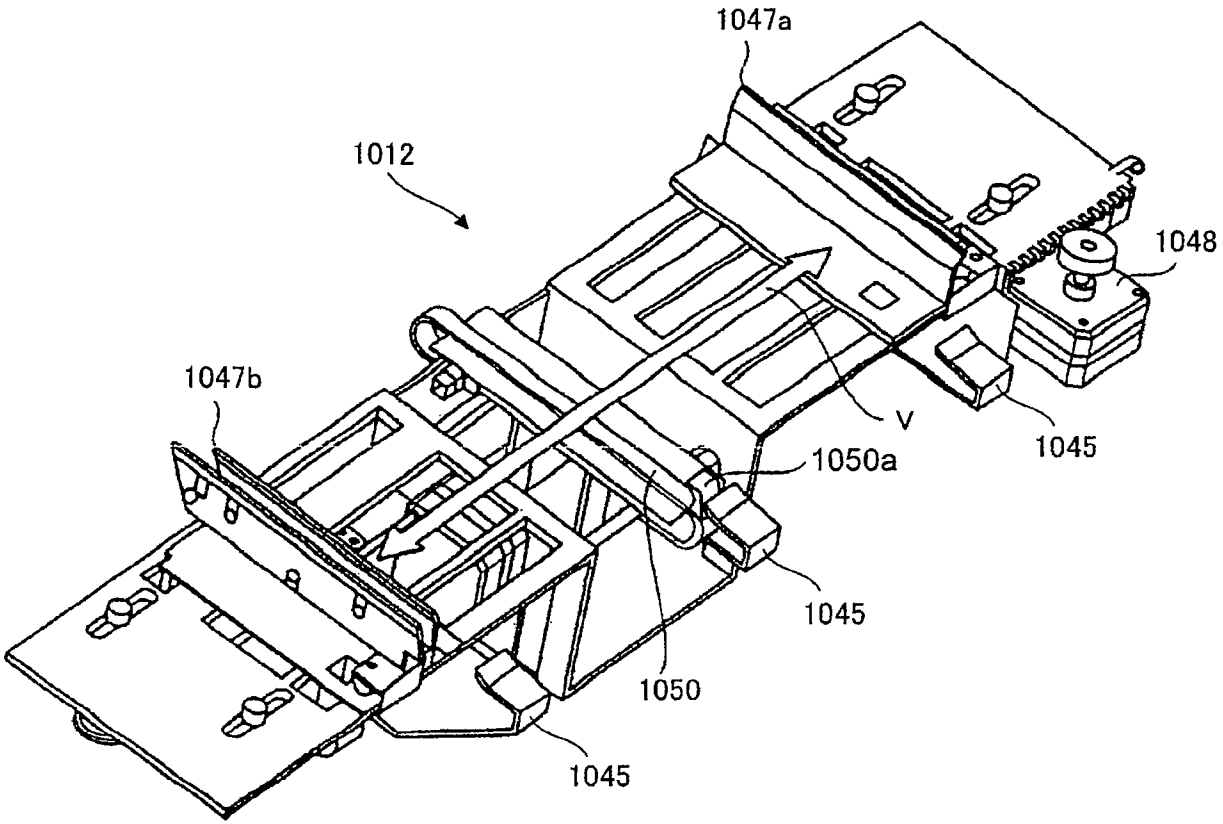
FIG. 16 is a schematic perspective view of lateral alignment plates according to the embodiment.

Lateral alignment plates 1047*a* and 1047*b* shown in FIG. 16 are provided in the processing tray 1012. When the pair of sheet supporting surfaces of the waiting tray 1010 open to drop the sheet P on the waiting tray 1010 onto the processing tray 1012, the lateral alignment plates 1047*a* and 1047*b* perform lateral alignment to prevent the sheet P from being disordered in the lateral direction orthogonal to the conveying direction. The lateral alignment plates 1047*a* and 1047*b* are slidably provided to be adjusted to the width of the sheet P by a lateral alignment motor 1048 as indicated by an arrow v.

Actions of the finishing apparatus 1007 are explained below. When the sheet P is subjected to image formation in the image forming apparatus 1005 and discharged from the paper discharge rollers 1006, the inlet rollers 1022 perform a different operation according to whether the sheet P is subjected to finishing or whether the preceding sheet P is being subjected to the finishing or the finishing ends.

If the sheet P is not subjected to the finishing, for example, the first paper discharge tray 1016 slides to a position indicated by a dotted line in FIG. 12, therefore, the sheet P discharged from the waiting tray 1010 can be stacked with high alignability. If the sheet P is not subjected to the finishing, the sheet P conveyed from the inlet rollers 1022 to the paper feeding rollers 1024 via the paper guide 1036 is conveyed onto the waiting tray 1010 by the paper feeding rollers 1024. Subsequently, the sheet P is conveyed by the waiting tray roller 1028, which is lowered onto the waiting tray 1010 and rotated in an arrow f direction, and discharged onto the first paper discharge tray 1016.

Figure 17:
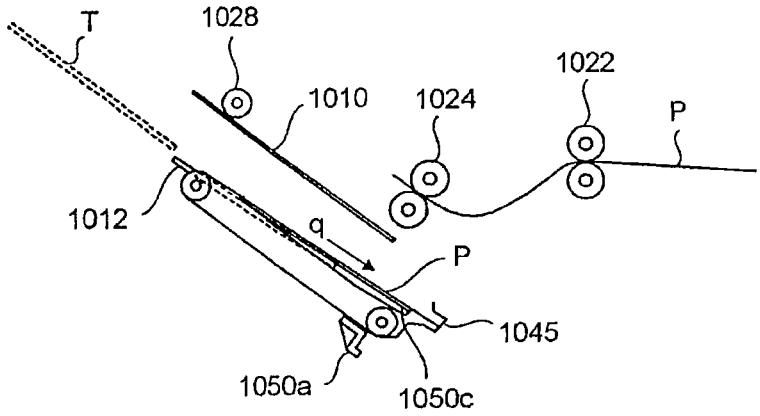
FIG. 17 is a diagram for explaining a state in which a sheet on a waiting tray or a paper discharge tray according to the embodiment is pushed out.

In this way, the sheets P are sequentially stacked on the first paper discharge tray 1016. The first paper discharge tray 1016 is arranged at the tilt angle θ2. The leading end of the sheet P is higher than the trailing end of the sheet P. Therefore, for example, even if the sheet P is discharged onto the first paper discharge tray 1016 in a state in which the sheet P is curled like a mound as indicated by a dotted line in FIG. 17, the preceding sheet P placed on the first paper discharge tray 1016 is not pushed out because of contact with the leading end of the following sheet P.

The discharged sheets P are sequentially placed on the first paper discharge tray 1016 without being out of order. Even if the preceding sheet P is pushed by the following sheet P and a slight positional shift occurs, since the first paper discharge tray 1016 is arranged at the tilt angle θ2, the sheets P drop with the own weight thereof and are aligned and stacked with the trailing ends thereof aligned on the first paper discharge tray 1016. Paper discharge processing for the sheets P is completed.

When the clip processing as the finishing is performed, if no preceding sheet P being subjected to the clip processing is present on the processing tray 1012, processing explained below is performed.

In this case, the pair of sheet supporting surfaces of the waiting tray 1010 open to drop the sheet P onto the processing tray 1012. As shown in FIG. 6, in order to align the dropped sheet P in the lateral direction, the lateral alignment plates 1047*a* and 1047*b* are arranged such that the width between the lateral alignment plates 1047*a* and 1047*b* is substantially the same as the width of the sheet P. Consequently, the sheet P conveyed by the paper feeding rollers 1024 is dropped onto the processing tray 1012 through the waiting tray 1010.

As shown in FIG. 14, when the sheet P drops, the upper longitudinal alignment roller 1038*a* is retracted upward and the receiving section 1044*a* of the paddle 1044 receives the trailing end of the sheet P. The sheet P drops with both sides thereof in contact with the lateral alignment plates 1047*a* and 1047*b* and is aligned in the lateral direction. Subsequently, the paddle 1044 rotates in an arrow O direction, drops the trailing end of the sheet P from the receiving section 1044*a*, and taps down the sheet P onto the processing tray 1012 with the tapping section 1044*b*.

Further, the paddle 1094 feeds the sheet P in an arrow q direction with the feeding section 1044*c* and brings the trailing end of the sheet P into contact with the stopper 1045 to complete alignment in the longitudinal direction of the sheet P. The alignment in the longitudinal direction of the sheet P on the processing tray 1012 may be performed by the upper longitudinal alignment roller 1038*a* moved up and down every time the alignment is performed.

In this way, the sheets P subjected to image formation are stacked on the processing tray 1012 from the paper feeding rollers 1024 through the waiting tray 1010 while being sequentially aligned in the lateral direction and the longitudinal direction. When the sheets P reach a predetermined number, first, the clip unit 1014 changes the position thereof from the home position to be parallel to the front ends of the sheets P (with respect to ends in the sheet conveying direction) and moves to near the center of the sheet width dimension.

Subsequently, the clip unit 1014 moves in the outward direction of the sheet width in parallel to the front ends of the sheets P by a distance of ¼ to ⅓ of the width dimension of the sheets P from near the center of the sheet width. The clip unit 1014 moved from near the center of the sheet width to the predetermined position rotates at an angle smaller than 45 degrees, for example, 30 degrees in the predetermined position and further moves in the outward direction of the sheet width. After moving forward by a moving distance corresponding to the sheet width, the clip unit 1014 subjects the sheets P on the processing tray 1012 to the clip processing in a desired position to change the sheets P to a bundle shape and form a sheet bundle.

Thereafter, the upper longitudinal alignment roller 1038*a* is lowered onto the sheet bundle. The upper longitudinal alignment roller 1038*a* rotating in an arrow r direction and the lower longitudinal alignment roller 1038*b* rotating in an arrow s direction hold the sheet bundle and conveys the sheet bundle in the direction of the first paper discharge tray 1016.

When a trailing end of the sheet bundle passes the upper and lower longitudinal alignment rollers 1038*a* and 1038*b*, the sheet bundle is hooked by the feeding pawl 1050*a* of the conveyor belt 1050 moved in an arrow t direction and is conveyed onto the first paper discharge tray 1016.

At this point, the first paper discharge tray 1016 is slid from the position indicated by the dotted line to a position indicated by a solid line in FIG. 12. The first paper discharge tray 1016 is arranged at the tilt angle θ2 and the leading end of the sheet P is higher than the trailing end of the sheet P. Therefore, the preceding sheet P conveyed onto the first paper discharge tray 1016 is not pushed out because of contact with the leading end of the following sheet bundle. Even if the preceding sheet bundle is pushed by the following sheet P and a slight positional shift occurs, since the first paper discharge tray 1016 is arranged at the tilt angle θ2, the sheet bundle drops with the own weight thereof and is aligned and stacked with the trailing end thereof aligned on the first paper discharge tray 1016. The clip processing for the sheets P is completed.

When the clip processing as the finishing is performed, if the preceding sheet P being subjected to the clip processing remains on the processing tray 1012, processing explained below is performed.

In this case, the sheet P can be supported on the waiting tray 1010. The waiting tray roller 1028 is retracted to above the waiting tray 1010 not to obstruct the sheet P. The sheet P discharged from the image forming apparatus 1005 and fed by the paper feeding rollers 1024 is once placed on the waiting tray 1010 to wait for the processing tray 1012 to be emptied.

The sheet P placed on the waiting tray 1010 is longitudinally aligned by the waiting tray roller 1028 rotated in a direction opposite to the arrow f direction (see FIG. 12). Further, since the waiting tray 1010 is arranged at the tilt angle θ1 and the leading end of the sheet P is higher than the trailing end of the sheet P, the sheet P is longitudinally aligned by the own weight thereof as well.

Since the waiting tray 1010 is arranged at the tilt angle θ1, for example, even if the sheet P is fed from the paper feeding rollers 1024 onto the waiting tray 1010 in a state in which the sheet P is curled like a mound, the preceding sheet P placed on the waiting tray 1010 is not pushed out because of contact with the leading end of the following sheet P. In other words, the fed sheets P are sequentially placed on the waiting tray 1010 without being out of order. Even if the preceding sheet P is pushed by the following sheet P and a slight positional shift occurs, since the waiting tray 1010 is arranged at the tilt angle θ1, the sheets P drop with the own weight thereof and are aligned and stacked with the trailing ends thereof aligned on the waiting tray 1010.

While the sheets P are aligned and stacked on the waiting tray 1010, if the preceding sheet P on the processing tray 1012 is discharged onto the first paper discharge tray 1016 side and the processing tray 1012 is emptied, the waiting tray 1010 drops the sheets P onto the processing tray 1012. The lateral alignment plates 1047*a* and 1047*b* are arranged such that a space between the lateral alignment plates 1047*a* and 1047*b* is substantially the same as the width of the sheet P. Therefore, the sheets P dropped from the waiting tray 1010 are aligned in the lateral direction with both the sides of the sheets P regulated by the lateral alignment plates 1047*a* and 1047*b*.

Figure 19:
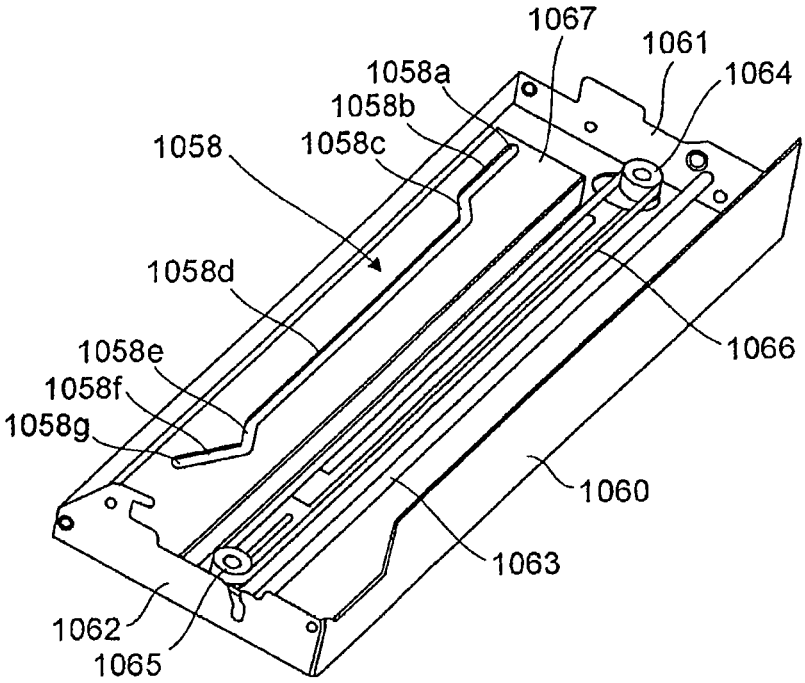
FIG. 19 is a diagram of a structure of a frame to which the clip unit according to the embodiment is attached.

As shown in FIG. 19, the sheet P on the lower side of the two sheets P dropped onto the processing tray 1012 is fed in the arrow q direction by the lower longitudinal alignment roller 1038*b* rotated in a direction opposite to the arrow s direction. The trailing end of the sheet P is brought into contact with the stopper 1045 and the alignment in the longitudinal direction of the sheet P is completed. The sheet P on the upper side of the two sheets P dropped onto the processing tray 1012 is fed in the arrow q direction by the upper longitudinal alignment roller 1038*a* rotated in a direction opposite to the arrow r direction. The trailing end of the sheet P is brought into contact with the stopper 1045 and the alignment in the longitudinal direction of the sheet P is completed. Thereafter, the upper longitudinal alignment roller 1038*a* is retracted upward.

The third and subsequent sheets P discharged from the image forming apparatus 1005 are directly dropped onto the processing tray 1012 without being caused to wait on the waiting tray 1010. Thereafter, the third and subsequent sheets P are sequentially aligned by the paddle 1044 on the sheets P stacked on the processing tray 1012 earlier.

When the sheets P stacked on the processing tray 1012 reach the predetermined number, first, the clip unit 1014 changes the position thereof from the home position to be parallel to the front ends of the sheets P (with respect to the ends in the sheet conveying direction) and moves to near the center of the sheet width dimension. Subsequently, the clip unit 1014 moves in the outward direction of the sheet width in parallel to the front ends of the sheets P by a distance of ¼ to ⅓ of the width dimension of the sheets P from near the center of the sheet width. The clip unit 1014 moved from near the center of the sheet width to the predetermined position rotates at an angle smaller than 45 degrees, for example, 30 degrees in the predetermined position and further moves in the outward direction of the sheet width. After moving forward by a moving distance corresponding to the sheet width, the clip unit 1014 clips the sheets P on the processing tray 1012 in a desired position to change the sheets P to a bundle shape and form a sheet bundle.

Thereafter, the sheet bundle is conveyed in the direction of the first paper discharge tray 1016 by the upper and lower longitudinal alignment rollers 1038*a* and 1038*b*. Further, the trailing end of the sheet bundle is hooked by the feeding pawl 1050*a* (see FIG. 17) of the conveyor belt 1050 and the sheet bundle is conveyed onto the first paper discharge tray 1016. The clip processing for the sheets P is completed.

Figure 18:
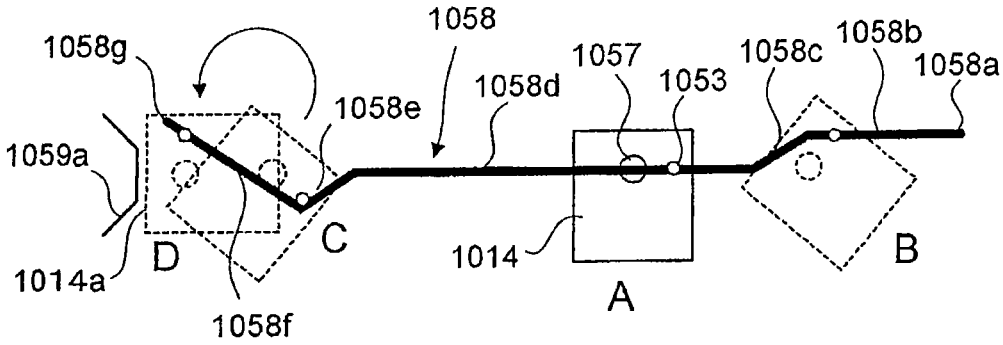
FIG. 18 is a diagram of a relation between a clip unit and a slit in the embodiment.

A moving mechanism configured to move the clip unit 1014 is explained in detail. Directions of the clip unit 1014 at the time when a guide pin 1053 provided in the clip unit 1014 moves along a slit 1058 and a positional relation of a clip insertion port 1059*a* during clip in this embodiment are shown in FIG. 18.

The slit 1058 includes one slit in which, starting from a first end 1058*a* on the right side, a first linear section 1058*b*, a first inclined section 1058*c*, a second linear section 1058*d*, a second inclined section 1058*e*, a third linear section 1058*f*, and a second end 1058*g* continue.

A center 1057 in performing the clip processing is present in the clip unit 1014. The directions of the clip unit 1014 indicated by dotted lines change according to a relation between the clip unit center 1057 and the guide pin 1053.

In the finishing apparatus 1007, when it is instructed in advance to perform the clip processing, first, the clip unit 1014 moves to a position A. When it is instructed in advance whether a position for stopping a sheet is the upper right or the upper left, the clip unit 1014 moves to a position B or a position C and the clip processing is performed.

On the other hand, as in this embodiment, when a bundle of sheets once discharged is inserted from the clip insertion port 1059*a*, the clip unit 1014 moves to a position D and rotates as indicated by an arrow to face a direction of the clip insertion port 1059*a*.

A structure of a frame 1060 in which the clip unit 1014 is moved along a guide is shown in FIG. 19. As shown in FIG. 19, the frame 1060 to which the clip unit 1014 is attached has an elongated box shape.

A rail 1063 of a round bar shape is arranged to extend between one side edge 1061 and the other side edge 1062 of the frame 1060. A first pulley 1064 is provided near the side edge 1061 and a second pulley 1065 is provided near the side edge 1062 substantially in the center of the frame 1060.

The first pulley 1064 is connected to a not-shown motor to be driven to normally and reversely rotate. An endless belt 1066 is laid over the first pulley 1064 and the second pulley 1065. A slit table 1067 is provided on the opposite side of the rail 1063 across the endless belt 1066. The slit 1058 for controlling the movement of the clip unit 1014 is formed on the slit table 1067.

As explained with reference to FIG. 18, the slit 1058 includes one slit in which, starting from the first end 1058*a* on the upper right side, the first linear section 1058*b*, the first inclined section 1058*c*, the second linear section 1058*d*, the second inclined section 1058*e*, the third linear section 1058*f*, and the second end 1058*g* continue as shown in FIG. 19. The first inclined section 1058*c* and the second inclined section 1058*e* are inclined at an angle of 30 degrees smaller than 45 degrees with respect to the first linear section 1058*b* and the second linear section 1058*d*.

Figure 20:
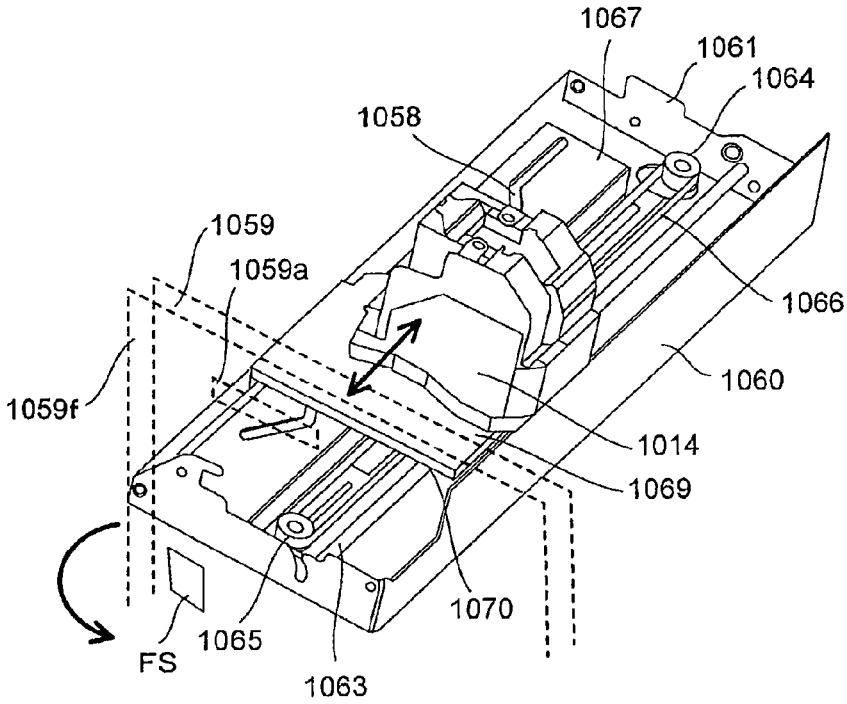
FIG. 20 is a perspective view of a clip unit moving mechanism in a state in which the clip unit according to the embodiment is attached to the frame shown in FIG. 19.

FIG. 20 shows a state in which the clip unit 1014 is movably attached on the frame 1060 shown in FIG. 19. The clip unit 1014 is moved along the total length of the slit 1058. The clip unit 1014 is swingably attached on a moving plate 1069. The guide pin 1053 is fixed to one end of the clip unit 1014. The guide pin 1053 is inserted in the slit 1058. Therefore, the clip unit 1014 swings to tilt at a predetermined angle along the shape of the slit 1058. The moving plate 1069 mounted with the clip unit 1014 is movably attached to the rail 1063 via a support pipe 1070 fixed to a lower surface of the moving plate 1069. The moving plate 1069 is attached to the endless belt 1066. The endless belt 1066 rotates in first and second directions according to the normal and reverse rotation of the first pulley 1064, over which the endless belt 1066 is laid, to move the moving plate 1069 in the first direction and the second direction opposite to the first direction.

Figure 13:
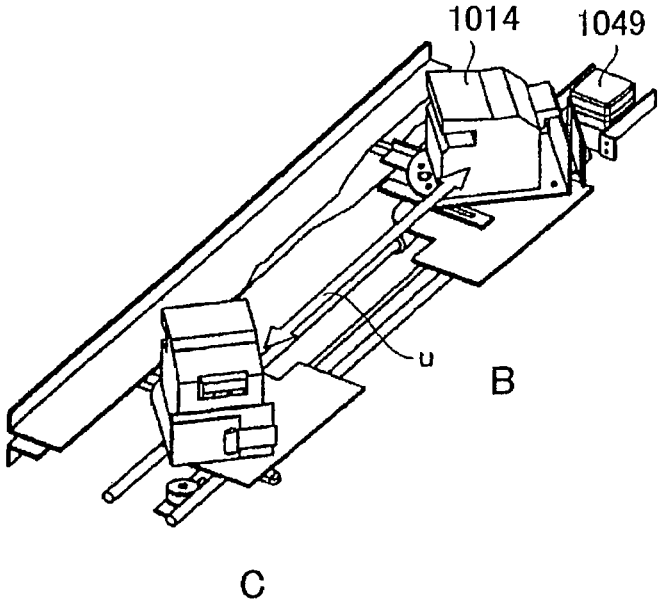
FIG. 13 is a perspective view of a clip processing device of the finishing apparatus and a moving mechanism of the clip processing device according to the embodiment.

According to the rotation of the endless belt 1066, the clip unit 1014 starts from the first end 1058*a* of the slit 1058 and rotates 30 degrees in a section where the clip unit 1014 changes from the first inclined section 1058*c* to the second linear section 1058*d*. A state of the clip unit 1014 rotated 30 degrees indicates a state of the clip unit 1014 in a position indicated by B in FIG. 13. A corner of plural sheets (a sheet bundle) SP desired to be clipped can be clipped by a paper clip of the clip unit 1014.

When the clip unit 1014 changes from the second linear section 1058*d* to the second inclined section 1058*e* to clip the corner of the sheet bundle SP with a clipping position changed, the clip unit 1014 rotates 30 degrees at the opposite tilt. A state of the clip unit 1014 rotated 30 degrees indicates a state of the clip unit 1014 in a position indicated by C in FIG. 14. Another corner of the sheets P can be automatically clipped by the paperclip of the clip unit 1014.

In the second linear section 1058*d*, the clip unit 1014 is parallel to an edge of the sheet bundle SP and operates to clip the sheets P with a pair of paper clips in one row. Moving speed of the clip unit 1014 between the pair of paper clips is about 310 mm/sec. Initial moving speed of the clip unit 1014 to one clip position or two clip positions is about 110 mm/sec. Moving speed of the clip unit 1014 at the initial time and to a sensor provided in the home position is about 90 mm/sec.

The slit 1058 according to this embodiment includes the third linear section 1058*f* and the second end 1058*g* continuous from the second inclined section 1058*e*. A front cover 1059*f* is provided in front of a clip cover 1059 (indicated by a dotted line in FIG. 20) in which the clip insertion port 1059*a* is provided. When the front cover 1059*f* is opened, a front cover detection sensor FS detects that the front cover 1059*f* is opened. When the front cover 1059*f* is opened, the clip unit 1014 is led by the slit 1058 to move to the third linear section 1058*f*. At this point, as indicated by the position D in FIG. 18, the clip unit 1014 rotates and an opening 1014*a* of the clip unit 1014 is faced to the clip insertion port 1059*a*.

With the moving mechanism of the clip unit 1014 explained above, it is possible to move the clip unit 1014 to the predetermined position along the shape of the slit 1058 with only one driving source and rotate the clip unit 1014 to the predetermined angle. Therefore, the structure of the clip unit 1014 is simple. In other words, another driving source for rotating the clip unit 1014 the predetermined angle is unnecessary.

Figure 21:
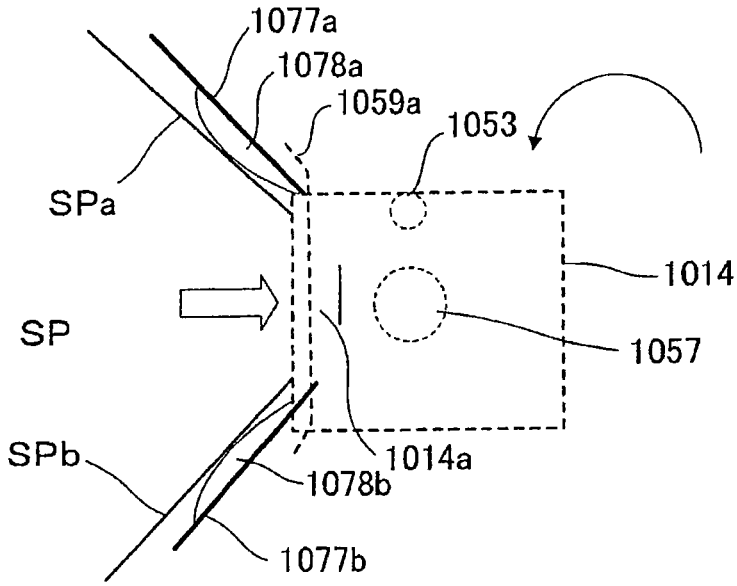
FIG. 21 is a diagram for explaining the clip unit into which a sheet bundle is inserted in the embodiment.
Figure 23:
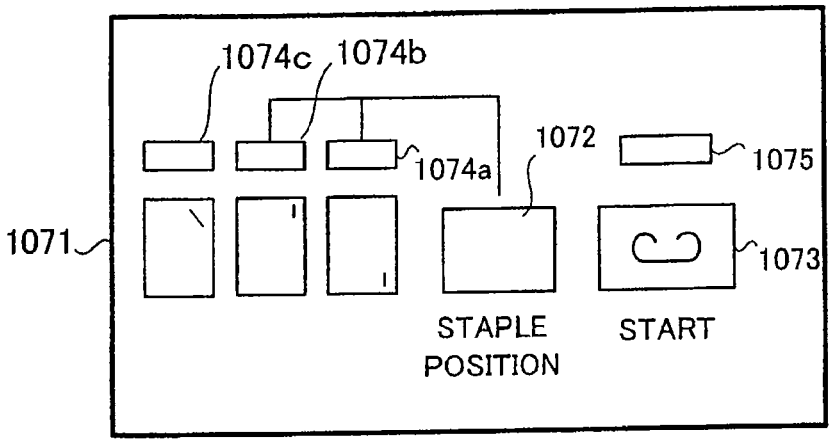
FIG. 23 is a plan view of an operation surface of the finishing apparatus according to the embodiment.

An operation unit for manual operation is provided in an upper part of the finishing apparatus 1007. As shown in FIG. 23, an upper surface 1071 of the operation unit includes a switch 1072 for clip position selection and a start switch 1073. Display sections 1074*a* and 1074*b* include LEDs that are lit in response to the selection switch 1072. When the display sections 1074*a* and 1074*b* are lit, this indicates that clip selection positions are positions shown below the display sections 1074*a* and 1074*b*. When a display section 1074*c* is lit, this means that the sheet bundle SP is subjected to the clip processing in a state in which a corner of the sheet bundle SP is manually inserted in the clip unit 1014 as shown in FIG. 21. When preparation for the clip processing is completed, for example, the start switch 1073 blinks. When the switch 1073 is pressed, a display section 1075 including an LED is lit. When the clip processing is completed, the start switch 1073 is lit.

A state of the finishing apparatus 1007 at the time when the sheet bundle SP to be subjected to the clip processing is inserted into the opening 1014*a* of the clip unit 1014 is shown in FIG. 21. The finishing apparatus 1007 includes contact sections 1077*a* and 1077*b* with which edges SPa and SPb of the sheet bundle SP come into contact when the sheet bundle SP is inserted into the opening 1014*a* of the clip unit 1014. Edge detection switches 1078*a* and 1078*b* are provided in the contact sections 1077*a* and 1077*b*. The edge detection switches 1078*a* and 1078*b* are, for example, actuator switches. The edge detection switches 1078*a* and 1078*b* are usually off and are turned on when pressed by the edges SPa and SPb of the sheet bundle SP.

Figure 22:
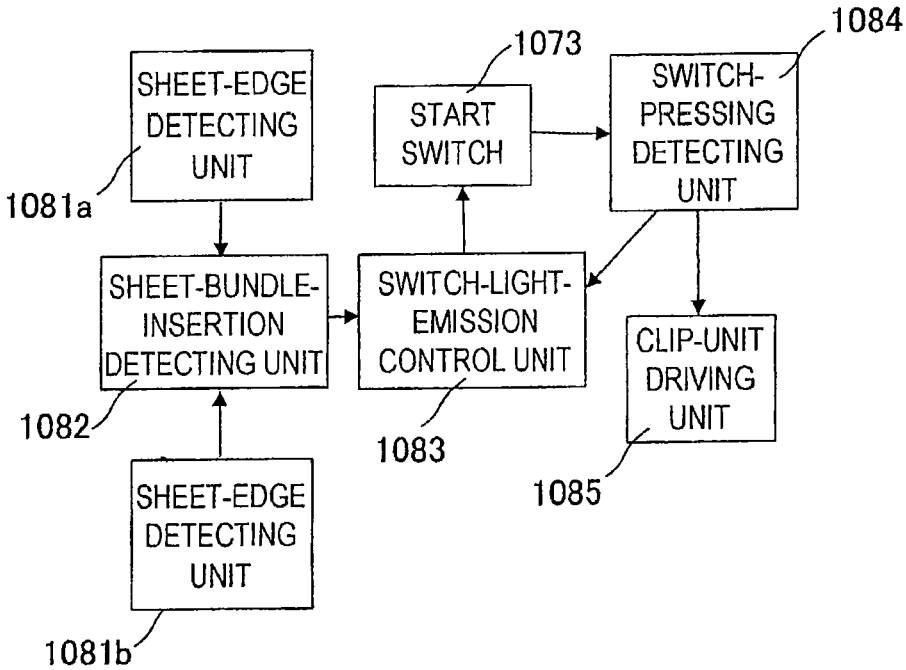
FIG. 22 is a diagram of a configuration example of an electric circuit of a clip processing unit that subjects the sheet bundle to clip processing in the embodiment.

A configuration example of an electric circuit of an insertion clip processing unit at the time when the clip processing is performed according to insertion of a sheet bundle is shown in FIG. 22. The insertion clip processing unit includes sheet-edge detecting units 1081*a* and 1081*b* configured to detect the edges SPa and SPb of the sheet bundle SP with the edge detection switches 1078*a* and 1078*b*, a sheet-bundle-insertion detecting unit 1082 configured to detect that both the edge detection switches 1078*a* and 1078*b* are turned on and detect insertion of the sheet bundle SP, a switch-light-emission control unit 1083 configured to cause, when the sheet-bundle-insertion detecting unit 1082 detects the insertion of the sheet bundle SP, the start switch 1073 to blink and emit light to indicate completion, a switch-pressing detecting unit 1084 configured to detect, when the start switch 1073 is pressed by the operator, the pressing and send a control signal to the switch-light-emission control unit 1083 to stop the light emission of the start switch 1073, and the clip-unit driving unit 1085 configured to drive the clip unit 1014 according to a detection signal from the switch-pressing detecting unit 1084 and cause the clip unit 1014 to perform the clip processing.

Figure 24:
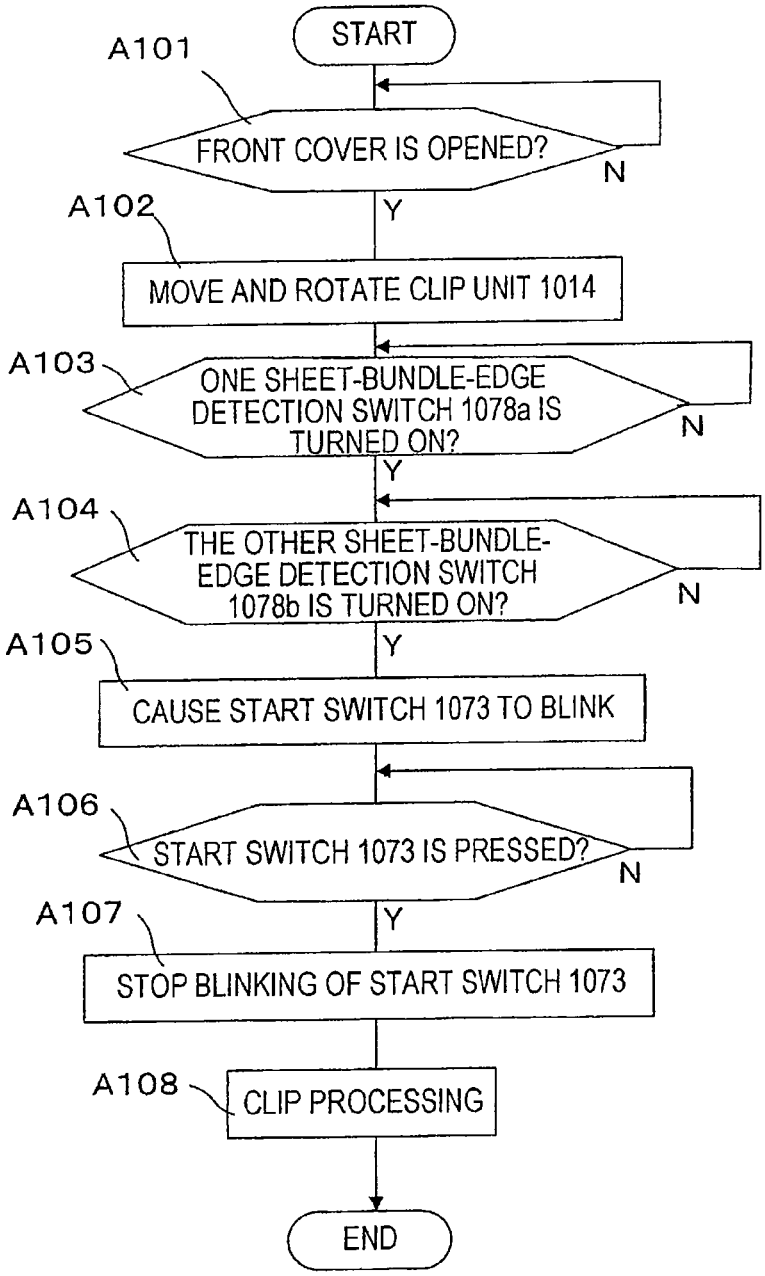
FIG. 24 is a flowchart for explaining an operation according to the embodiment.

Operations in a manual mode in which an end of the sheet bundle SP desired to be subjected to the clip processing is inserted into the opening 1014*a* of the clip unit 1014 and the clip processing is performed are explained with reference to a flowchart of FIG. 24.

When the clip processing is started, first, in Act A101, the insertion clip processing unit detects whether the front cover 1059*f* of the finishing apparatus 1007 is opened. If the front-cover detection sensor FS detects that the front cover 1059*f* is opened, the insertion clip processing unit moves the clip unit 1014 to the third liner unit 1058*f* and rotates the clip unit 1014 (Act A102). The operator inserts the sheet bundle SP into the clip insertion port 1059*a* in a state in which the front cover 1059*f* is opened.

In Act A103, the insertion clip processing unit detects whether one sheet-bundle-edge detection switch 1008*a* is turned on. If it is detected that the sheet-bundle-edge detection switch 1008*a* is turned on, in Act A104, the insertion clip processing unit detects whether the other sheet-bundle-edge detection switch 1008*b* is turned on. If the sheet-bundle-edge detection switch 1008*a* is not turned on, the insertion clip processing unit cannot shift to Act A104 for detecting whether the other sheet-bundle-edge detection switch 1008*b* is turned on. The insertion clip processing unit waits until the sheet-bundle-edge detection switch 1008*a* is turned on. If the sheet-bundle-edge detection switch 1008*b* is not turned on, the insertion clip processing unit cannot shift to the next stage (A105). Both the sheet-bundle-edge detection switches 1008*a* and 1008*b* are turned on by adjacent edges of two sides of the sheet bundle SP. If both the sheet-bundle-edge detection switches 1008*a* and 1008*b* are turned on, this means that, as shown in FIG. 11, the sheet bundle SP is inserted deep into the opening 1014*a* of the clip unit 1014 and the clip processing can be properly performed.

If both the sheet-bundle-edge detection switches 1008*a* and 1008*b* are turned on, the sheet-bundle-insertion detecting unit 1082 detects completion of preparation for the clip processing and sends a control signal to the switch-light-emission control unit 1083. The switch-light-emission control unit 1083 sends a blinking control signal to the start switch 1073 and, in the next Act A105, causes the start switch 1073 to blink. The blinking of the start switch 1073 informs the operator that a sheet bundle about to be subjected to the clip processing is inserted into the clip insertion port 1059*a* and the clip unit 1014 is in an appropriate state, i.e., a state of the completion of the preparation for the clip processing. Instead of the blinking, the start switch 1073 may be continuously lit. The lighting includes blinking and continuous lighting.

In the next Act A106, the switch-pressing detecting unit 1084 detects whether the start switch 1073 is pressed. If the switch-pressing detecting unit 1084 detects in Act A106 that the start switch 1073 is pressed, i.e., the switch-pressing detecting unit 1084 receives a switch pressing signal from the start switch 1073, the switch-pressing detecting unit 1084 sends a blinking stop control signal to the switch-light-emission control unit 1083. In Act A107, the switch-pressing detecting unit 1084 stops the blinking of the start switch 1073. The display section 1075 is lit from this point.

In the next Act A108, the switch-pressing detecting unit 1084 sends a driving control signal to the clip-unit driving unit 1085. The clip-unit driving unit 1085 causes the clip unit 1014 to perform the clip processing.

Although not explained in detail herein, if the front cover 1059*f* of the finishing apparatus 1007 is not opened and the clip processing is instructed, the clip unit 1014 is guided by the slit 1058 on the slip table 1067 to move and automatically applies, in the predetermined position, the clip processing to a sheet bundle conveyed to the Clip unit 1014.

According to this embodiment, the clip unit usually used for the clip processing of the finishing apparatus can also be used when the finishing apparatus subjects a sheet bundle to the clip processing in the manual mode. Therefore, even if it is not instructed in advance to automatically perform the clip processing, it is possible to easily clip the sheet bundle.

In this embodiment, when the front cover is opened, the finishing apparatus detects the opening of the front cover and automatically changes to the manual mode. Therefore, to change the finishing apparatus to the manual mode, the operator only has to open the front cover and does not need to specifically instruct the manual mode.

In the example explained in this embodiment, when the two switches with which the adjacent edges of a sheet bundle come into contact are turned on, the start switch is blinked to inform the operator of completion of preparation for the clip processing. When the operator presses the start switch, the clip processing is performed. However, the completion of the preparation for the clip processing may be indicated by lighting of the start switch or may be informed to the operator by another switch or a lamp. It is also possible to automatically perform the clip processing when the preparation for the clip processing is completed even if the operator does not press the switch. In this case, for example, in FIG. 22, an output of the sheet-bundle-insertion detecting unit 1082 may be input to the clip-unit driving unit 1085.

In the explanation in this embodiment, when the finishing apparatus of the image forming apparatus changes to the manual mode, the clip unit 1014 subjects an inserted sheet bundle to the clip processing.

However, the clip unit 1014 does not need to be incorporated in the finishing apparatus. The present invention can also be separately used as a clip device. In this case, as in the case explained above, when a sheet bundle is inserted into an opening of a clip, pressing switches on both sides of the opening are turned on, detect that the sheet bundle is properly inserted, and inform the operator of the completion of the preparation for the clip processing using a lamp or the like. When the operator presses a switch for the clip processing, the clip processing is performed.

According to this embodiment, it is possible to perform the clip processing in the finishing apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit configured to form an image on a sheet;

an apparatus main body including the image forming unit therein;

a recessed section provided on an outer side of the apparatus main body;

a sheet detecting unit configured to detect insertion of the sheet into the recessed section; and a clip unit configured to clip an end of the sheet with a paper clip when the sheet detecting unit detects insertion of the sheet into the recessed section.

2. The apparatus according to claim 1, wherein the recessed section is provided at a corner of the apparatus main body.

3. The apparatus according to claim 2, wherein the clip unit includes:

a clip supplying unit configured to supply the paper clip made of an elastic member that urges opposed side surface sections thereof together, the paper clip having a C shape in section; and a clip processing unit configured to nip the sheet with the clip.

4. The apparatus according to claim 3, wherein the clip processing unit operates to open distal ends of the side surface sections and nips the sheet when the paper clip is pressed by a pressing member from a rear surface of the paper clip.

5. The apparatus according to claim 4, wherein the sheet detecting unit is an optical device configured to detect the insertion of the sheet into the recessed section when a light path in the optical device is blocked by the inserted sheet.

6. The apparatus according to claim 5, wherein the sheet detecting unit includes: a light source configured to emit light and a light receiving unit configured to receive the light from the light source.

7. The apparatus according to claim 6, wherein:

the apparatus main body includes, on an upper surface thereof, an operation panel including a clip key, and when the clip key is pressed, the clip unit clips the end of the sheet with the paper clip.

8. The apparatus according to claim 7, wherein when the clip key is pressed and when the sheet detecting unit detects the insertion of the sheet into the recessed section, the clip unit clips the end of the sheet with the paper clip.

9. The apparatus according to claim 1, wherein when the sheet detecting unit detects the insertion of the sheet into the recessed section, the clip unit automatically clips the end of the sheet with the paper clip.

10. The apparatus according to claim 8, wherein the operation panel further includes a display configured to display states of the units.

11. The apparatus according to claim 10, wherein if the insertion of the sheet is not detected by the sheet detecting unit, the display displays a comment urging an operator to correctly insert the sheet.

12. The apparatus according to claim 10, wherein if there is no paper clip supplied from the clip supplying unit when the clip key is pressed, the display displays a comment urging an operator to supply a paper clip.

13. An image forming apparatus comprising:

a latent-image forming unit configured to form a latent image on a photoconductive member;

a developing unit configured to develop, with a toner, the latent image formed by the latent-image forming unit;

a transfer unit configured to transfer a toner image developed by the developing unit onto a sheet;

a fixing unit configured to fix, on the sheet, the toner image transferred by the transfer unit;

an apparatus main body including the latent-image forming unit, the developing unit, the transfer unit, and the fixing unit therein;

a recessed section provided on an outer side of the apparatus main body; and a sheet detecting unit configured to detect insertion of the sheet into the recessed section; and a clip unit configured to clip an end of the sheet with a paper clip when the sheet detecting unit detects insertion of the sheet into the recessed section.

14. The apparatus according to claim 13, wherein the recessed section is provided at a corner of the apparatus main body.

15. The apparatus according to claim 14, wherein the clip unit includes:

a clip supplying unit configured to supply the paper clip made of an elastic member that urges opposed side surface sections thereof together, the paper clip having a C shape in section; and a clip processing unit configured to nip the sheet with the clip.

16. The apparatus according to claim 15, wherein the clip processing unit operates to open distal ends of the side surface sections and nips the sheet when the paper clip is pressed by a pressing member from a rear surface of the paper clip.

17. The apparatus according to claim 16, wherein:

the apparatus main body includes, on an upper surface thereof, an operation panel including a clip key, and when the clip key is pressed, the clip unit clips the end of the sheet with the paper clip.

18. The apparatus according to claim 17, wherein:

the operation panel further includes a display configured to display states of the units, and if the insertion of the sheet is not detected by the sheet detecting unit, the display displays a comment urging an operator to correctly insert the sheet.

* * * * *